US006460187B1

(12) United States Patent
Siegel

(10) Patent No.: US 6,460,187 B1
(45) Date of Patent: Oct. 8, 2002

(54) MEDICAL CLOTHING

(76) Inventor: Marilyn R. Siegel, 1143 Camino Viejo, Santa Barbara, CA (US) 93108

( * ) Notice: Subject to any disclaimer, the term of this patent is extended or adjusted under 35 U.S.C. 154(b) by 0 days.

(21) Appl. No.: 09/320,193

(22) Filed: May 26, 1999

(51) Int. Cl.[7] ..... A41D 13/12
(52) U.S. Cl. ..... 2/114; 2/24.7
(58) Field of Search ..... 604/174, 179, 604/345; 2/114, 94, 51, 102, 247, 48, 111, 112, 106, 49.1, 49.3, 49.2, 83, 69, 249, 250, 251, 52; D2/863, 864, 720; 128/DIG. 26; 600/388, 389

(56) References Cited

U.S. PATENT DOCUMENTS

| | | | | | |
|---|---|---|---|---|---|
| 2,692,989 | A | | 11/1954 | Jelstrup | |
| 3,276,036 | A | | 10/1966 | Cater | |
| 4,087,864 | A | * | 5/1978 | LeBove et al. | 2/102 |
| 4,547,907 | A | | 10/1985 | Netsky | |
| 4,578,062 | A | * | 3/1986 | Schneider | 604/174 |
| 4,698,848 | A | * | 10/1987 | Buckley | 2/114 |
| 4,718,124 | A | * | 1/1988 | Sawicki et al. | 2/114 |
| 4,837,863 | A | | 6/1989 | Van Scoy-Mosher | |
| 5,001,784 | A | | 3/1991 | Orlando, Jr. | |
| 5,048,122 | A | * | 9/1991 | Prieur | 2/69 |
| 5,142,702 | A | * | 9/1992 | Piloian | 2/102 |
| 5,150,477 | A | | 9/1992 | Elberson et al. | |
| 5,161,258 | A | * | 11/1992 | Coltrain | 2/102 |
| 5,184,351 | A | * | 2/1993 | Benstock | 2/114 |
| 5,336,195 | A | * | 8/1994 | Dameshvar | 604/179 |
| 5,566,391 | A | * | 10/1996 | Williamson | 2/51 |
| 5,652,961 | A | * | 8/1997 | Knight-Yurt | 2/114 |
| 5,755,698 | A | * | 5/1998 | Kagan et al. | 604/179 |
| 5,776,105 | A | * | 7/1998 | Corn | 604/174 |
| 5,806,096 | A | * | 9/1998 | Pennington | 2/80 |
| 5,832,536 | A | * | 11/1998 | Kramer | 2/69 |
| 5,897,519 | A | * | 4/1999 | Shesol et al. | 604/179 |
| 6,032,289 | A | * | 3/2000 | Villapiano | 2/102 |
| 6,065,154 | A | * | 5/2000 | Hulings et al. | 2/94 |

* cited by examiner

*Primary Examiner*—Amy B. Vanatta
(74) *Attorney, Agent, or Firm*—Leo F. Costello

(57) ABSTRACT

Multipurpose medical clothing, such as a gown or robe, that safely accommodates medical appliances attached to a patient, affords privacy, and thus encourages the patient to be up and ambulatory. The illustrated gown embodiment includes rectangular front and back panels open at the sides, belting, inside and outside pockets, and inside and outside hangers. The panels are of equal width greater than average human shoulder width to provide sleeves when worn. The belting extends from the back panel around the sides lower and is tied in front. The front panel is slightly shorter than the back panel so that the panels are of about the same height when the gown is worn and belted. The pockets are attached to the inside and outside of the front panel below the belt line at substantially the same height and in transversely spaced relation to each other. The hangers are attached to the inside and outside of the front panel respectively below the inside and outside pockets. The gown accommodates various medical appliances such as: a telemetry transmitter with its sensors attached to patient and its leads passing under the tied belting to relieve the pressure on the sensors; a catheter unit hung from either the inside or outside hangers, and thus below the patient's bladder, with its tubing coiled and supported on the hangers; and IV tubing threaded through one of the loops formed by a hangers and thus supported between an adjacent mobile stand and the patient.

19 Claims, 7 Drawing Sheets

MEDICAL CLOTHING

BACKGROUND

The trend for many years has been to minimize the time patients remain in a hospital or other care facility before discharge. There are various reasons for this trend, including the high cost of medical care as well as the availability of beds. Discharge from the hospital depends, of course, on the patient's condition, and the patient's condition may depend on whether or not the patient is ambulatory. With certain patients, however, getting up and walking is a struggle. This is especially true when the patient must be connected to various medical appliances, such as intravenous drips, epidural infusions, telemetry devices, and/or Foley catheters. Having to walk about with this equipment attached not only saps the patient's strength but is clumsy and may even be hazardous. Moreover, hospital gowns in common use discourage such patient activity.

Certain of the medical appliances in use require tubes or wires that are normally draped from a place of attachment on the patient's body to another part of the appliance. Walking around within tubing attached may be awkward for some patients. If the tubing is allowed to hang down, it may drag on the floor and possibly become entangled with the patient's feet or cause the patient to trip and fall. Moreover, since these appliances are connected to the body, either with tubing, or wire leads in the case of a telemetry device, they can create pulling forces on the various points of body attachment which may add to the patient's discomfort and cause a disconnection of the tubing or leads, resulting in possible adverse consequences to the patient and perhaps also in embarrassment.

In using an IV unit, the patient must be concerned not only with dangling tubing and its body attachment but also with maneuvering the mobile stand that holds the intravenous fluid supply. Catheter units on the other hand present some of the foregoing problems but also various concerns about the location of the receptacle. From a medical standpoint, keeping the bag below the bladder is very important in minimizing the risk of infection. Many patients consider their appearance of utmost importance and would prefer to hide the bag completely. These concerns are sometimes in conflict so that in trying to conceal the bag, the patient may not keep it in the best location medically.

The gowns in current use offer little if any assistance to the patient in these matters and may even add problems. That is, patients may be discouraged from becoming ambulatory merely because of the clothing that hospitals usually provide patients to wear during their hospital stay. Typically a hospital provides a patient with a gown that opens along the back and has short ties that connect in the back and do not wrap or tie around the gown. Not only do these standard gowns fail to give patients a sense of privacy and dignity, they offer little or no assistance to the patient in dealing with the medical equipment that is attached to the patient.

Efforts have been made to provide hospital gowns that afford the patient with more privacy. Examples of such gowns are disclosed in U.S. Pat. Nos. 4,547,907; 4,837,863; 5,001,784; and 5,150,477. These gowns, however, are more complicated in construction than they need be, and they fail to provide any assistance to the patient in handling attached medical appliances. Other gowns and robes are commercially available that again do not have a simple but functional construction, and although some provide a telemetry pocket, even that is not provided in the most useful manner.

SUMMARY

Multipurpose medical clothing, such as a gown or robe, is provided that safely accommodates medical appliances attached to a patient, affords privacy, and thus encourages the patient to be up and ambulatory. The clothing includes rectangular front and back panels open at the sides, belting, inside and outside pockets, and inside and outside hangers. The panels are of equal width greater than average human shoulder width to provide sleeves when worn, and may be wide enough to create a robe. The belting extends from the back panel around the sides lower and is tied in front. The front panel is slightly shorter than the back panel so that the panels are of about the same height when the gown is worn and belted. The pockets are attached to the inside and outside of the front panel below the belt line at substantially the same height and in transversely spaced relation to each other. The hangers are attached to the inside and outside of the front panel respectively below the inside and outside pockets. The gown or robe accommodates various medical appliances such as: a telemetry transmitter with its sensors attached to patient and its leads passing under the tied belting to relieve the pressure on the sensors; a catheter unit hung from either the inside or outside hangers, and thus below the patient's bladder, with its tubing coiled and supported on the hangers; and IV tubing threaded through one of the loops formed by a hangers and thus supported between an adjacent mobile stand and the patient.

An object of this invention is to encourage patients to be up and ambulatory while attached to such medical appliances as intravenous drips, epidural infusions, telemetry devices, and/or Foley catheters.

Another object is to enable patients to be dressed with a sense of privacy and dignity.

An additional object is to provide multipurpose medical clothing such as a gown or robe that accommodates medical appliances attached to a patient, affords privacy, and thus encourages the patient to be up and ambulatory.

A further object is to support a relatively heavy and cumbersome medical appliance in an accessible position on the clothing worn by the patient so that the pulling forces where the appliance is attached to the patient are relieved.

Still another object is to support elongated extension members, such as tubes and leads, on the clothing worn by the patient so that the extensions do not drag on the floor and do not cause the patient to trip over them, to relieve the patient from having to hold them, and to minimize tensions where the extensions connect to the patient and the appliance.

Yet another object is to support certain medical appliances on the gown, robe or other clothing being worn by a patient in such a position as is most favorable for the intended purposes of the appliances.

An additional object is to provide places on both the inside and the outside of a gown or robe where medical appliances can be supported.

A further object is to provide a gown or robe of simple construction that affords a patient wearing it privacy and dignity and yet affords access by various attendants to the patient and to medical appliances that may be attached to the patient.

Still a further object is to provide a gown or robe that is suitable for institutional as well as home use.

These and other objects, features and advantages of the present invention will become apparent upon reference to the following description, accompanying drawings, and appended claims.

DETAILED DESCRIPTION

Figure 1:
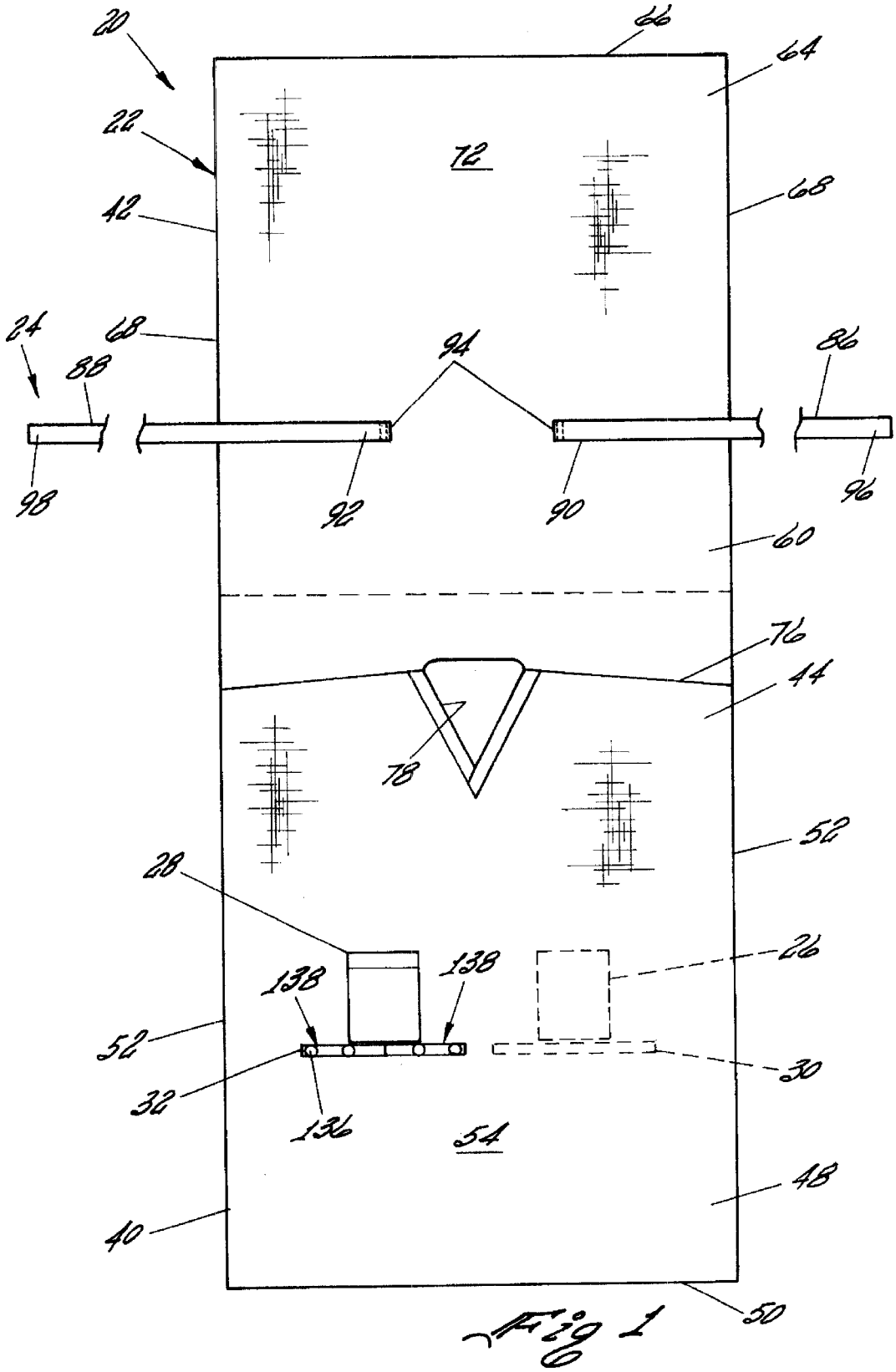
FIG. 1 is a plan view of the outside surfaces of the front and rear panels of a gown incorporating the principles of the present invention, the gown being opened up and spread out in a common plane, showing hidden features in dashed lines.

With reference to FIGS. 1–4, a gown embodiment of multipurpose medical clothing incorporating the principles of the present invention is identified by the numeral 20. The gown includes a garment generally indicated by the numeral 22, belting generally indicated by the numeral 24, inside and outside pockets 26 and 28, and inside and outside hangers 30 and 32. Although reference is made to a gown that slips on and off over the head, it will be understood as the description proceeds that the principles of the present invention are equally applicable to a robe that is slipped on and off from the arms, as well as other clothing, irrespective of its particular name, where similar problems and uses as described herein are involved. Each of the elements of the illustrated gown will now be described.

With continued reference to FIGS. 1–4, the garment 22 is preferably made of a cotton polyester fabric, although other materials suitable to the functions and purposes of the subject invention may be employed. The garment includes rectangular, front and back panels 40 and 42 of generally the same size, although the back panel is slightly longer, as will be seen. The garment may be made in this rectangular shape for ease of manufacture and also to allow enough fabric to wrap around the patient, depending on the patient's girth and also for the purpose of creating a sleeve portion, as will be subsequently described. The front panel has a top portion 44 terminating in an upper edge hidden by the sewing technique and not involved in the present invention. The front panel also has a bottom portion 48 that terminates in a lower edge 50, opposite side edges 52, an outside surface 54, and an inside surface 56. Thus, the width of the front panel is defined as the dimension between the side edges, whereas the length is defined as the dimension between the upper and lower edges measured from the juncture of the upper edge with each side edge. Although the subject invention is not limited to any particular dimensions, the length and width of the front panel in the preferred embodiment are approximately forty and thirty-six inches, respectively.

The back panel (FIGS. 1–4) also has a top portion 60 terminating in an upper edge [not shown] (62), a bottom portion 64 terminating in a lower edge 66, side edges 68, an inside surface 70 and an outside surface 72. The length and width dimensions of the back panel are measured in the same way as those of the front panel, but the length of the back panel is slightly longer than the length of the front panel. In the preferred embodiment disclosed, the length of the back panel is about forty-three inches, whereby the back panel is about three inches longer than the front panel. The purpose of this difference in dimensions will be explained subsequently.

The top portions 44 and 60 of the front and back panels 40 and 42 are sewed together using conventional sewing techniques and not forming part of the present invention except to note that the front and back panels thus meet in an upper seam 76. This seam is cut and sewn on a bias so that its opposite end portions diverge slightly downwardly toward the side edges 52 and 68. Portions are cut from the front and back panels to provide a head opening 78, preferably having a crossover V-neckline. The latter facilitates placing the garment 22 over a patient's head and removing the same and also has the advantage of minimizing the size of the head opening.

The belting 24 (FIGS. 1–4) includes left and right belt members 86 and 88, the reference to "left" and "right" being from the viewpoint of the wearer and being only for descriptive convenience since these belt members are identical in construction. Thus, the belt member have inner ends 90 and 92 respectively fastened in transversely spaced relation by stitching 94 to the outside surface 72 of the back panel 42 (FIG. 1) and free outer ends 96 and 98. Each belt member is long enough to extend from its point of attachment to the back panel, across the outside surface of the back panel, around the side edges 52 and 68, across the outside surface 54 of the front panel, and past the longitudinal centerline 100 of the garment. When fully extended, the outer end of each belt member terminates approximately three-quarters of the way across the front panel from the point where that particular belt member curves around the side edges of the two panels. Each inner end of the belt members is fastened to the back panel at approximately one-third of the width of the back panel measured inwardly from the adjacent side edge. More specifically, and with reference to the disclosed embodiment, the distance from each side edge to the adjacent inner end of the belt member is approximately twelve inches. Also, when the panels are flat against each other as shown in FIG. 3, for example, and the belt members are folded across the front of the garment, as described above, each outer end 96 and 98 of the belt members is spaced about ten inches from the closer side edge.

The dimensions of the garment 22 (FIGS. 7–11) and the belting 24 are calculated to enable the garment to be wrapped around most patients 110. Also, the placement of the belt members 86 and 88 provides a waste line or belt line, indicated generally by the number 106 in FIGS. 3 and 8, when tied in front. It should also be noted that the garment is wide enough so that when placed on a patient 110, the panels 40 and 42 form sleeve portions 112 and 114. It will be understood that these sleeves are open underneath or at the bottom and are not sewed, or otherwise fastened, again to facilitate access to the interior of the gown, for patient comfort, and to facilitate putting on and taking off the gown. Although the belting 24 is preferably tied in front, it can be tied in the back leaving the sides completely open, if desired. In any event, it is to be recognized that the sides of the subject gown 20 are open, facilitating outward access by the patient and inward access by the attending medical personnel. Also, it is to be noted that the belting is set a little lower than normal thereby allowing for casted or dressed arms and shoulders, large bosoms and chests, and esthetics.

With further reference to the gown 20 (FIGS. 3, 5, 6 and 11), the inner pocket 26 is sewn to the inside surface 56 of the front panel 40 on one side of the longitudinal centerline 100 of the garment 22 and slightly below the belt line 106. The outer pocket 28 is sewn to the outside surface 54 of the front panel 40 on the opposite side of the longitudinal centerline from the inside pocket and in generally horizontal alignment with the inside pocket.

Figure 2:
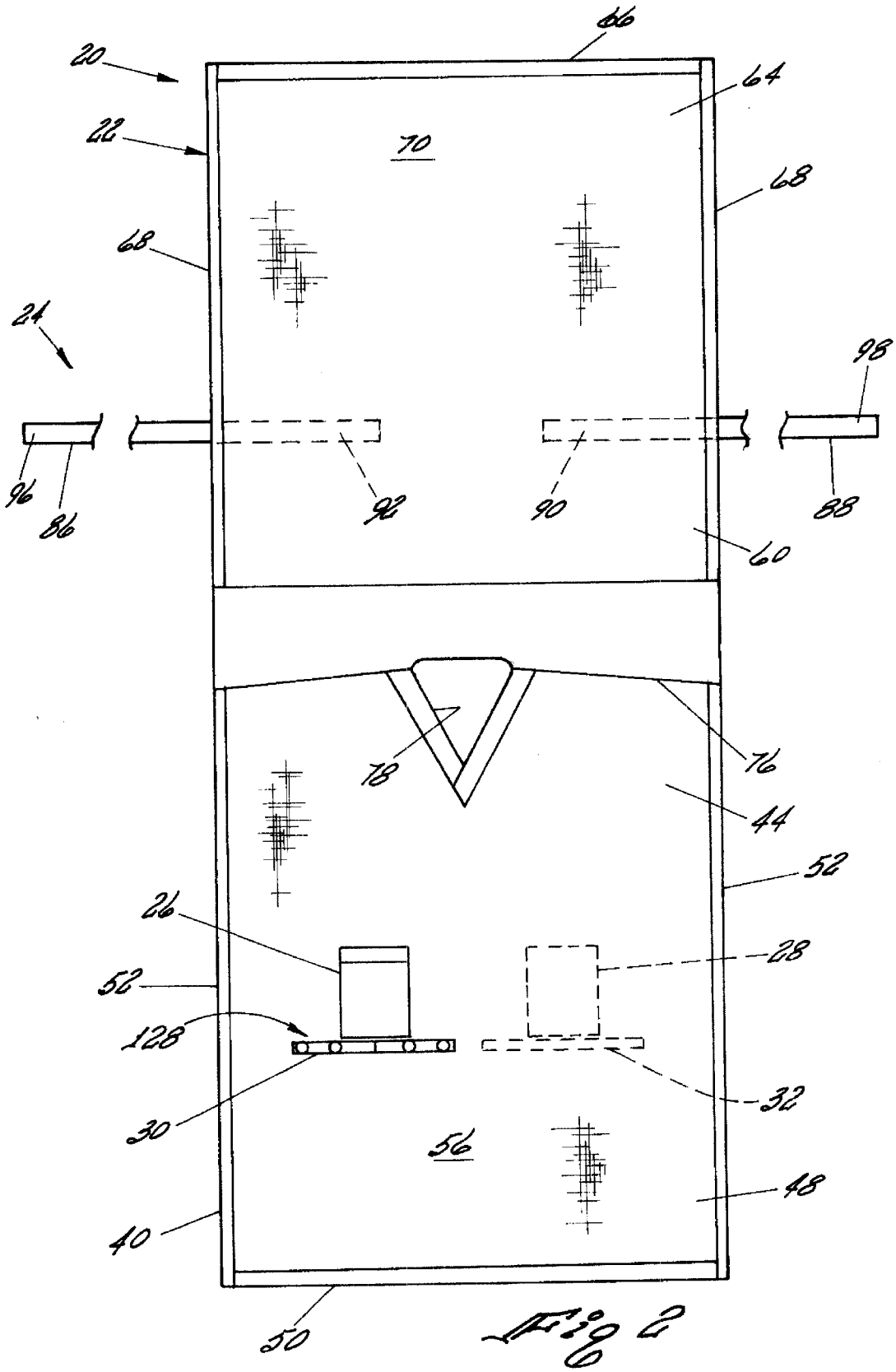
FIG. 2 is a plan view of the inside surfaces of the front and rear panels of the gown opened up and spread out in a common plane, showing hidden features in dashed lines.
Figure 3:
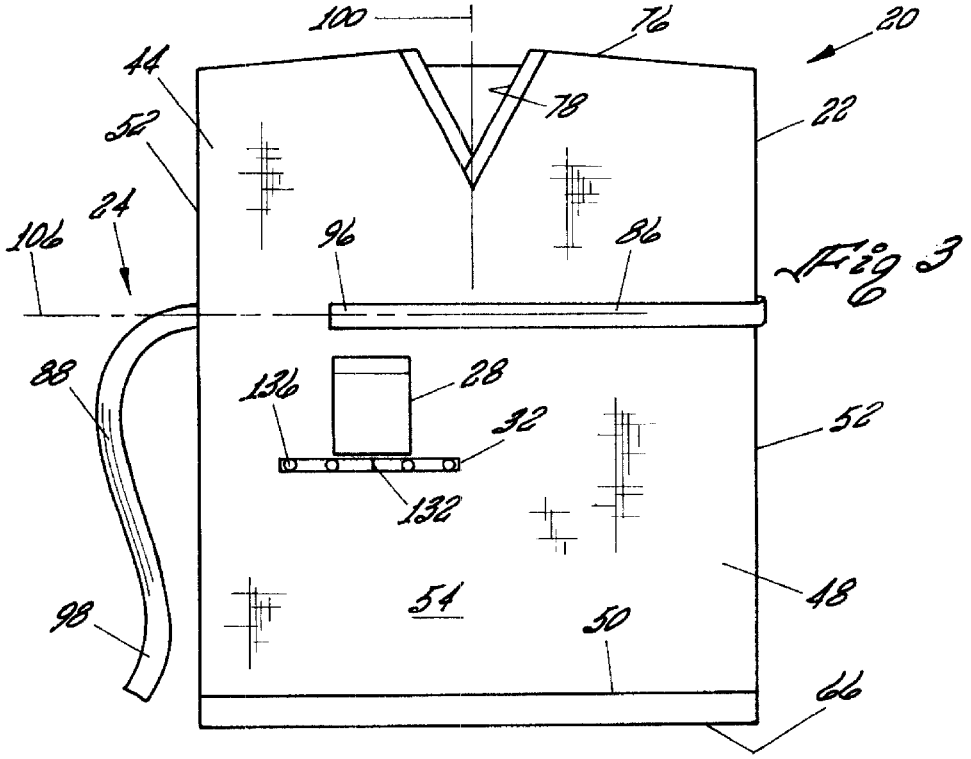
FIG. 3 is a front plan of the gown with the belting not tied.
Figure 4:
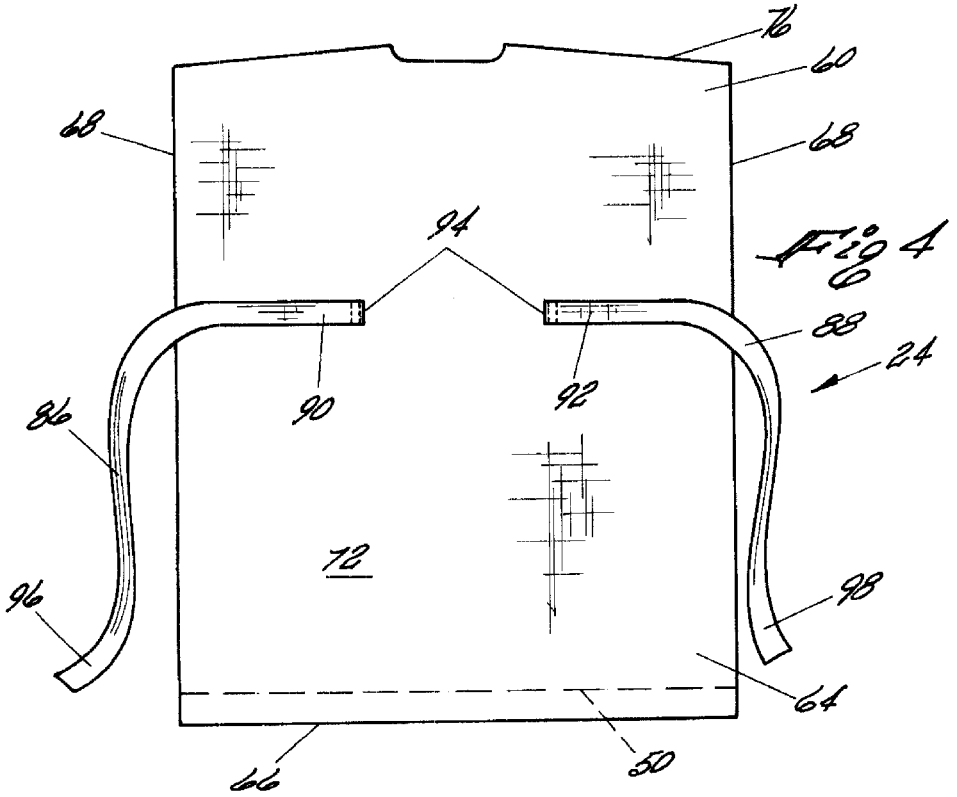
FIG. 4 is a rear plan of the gown with the belting not tied.
Figure 5:
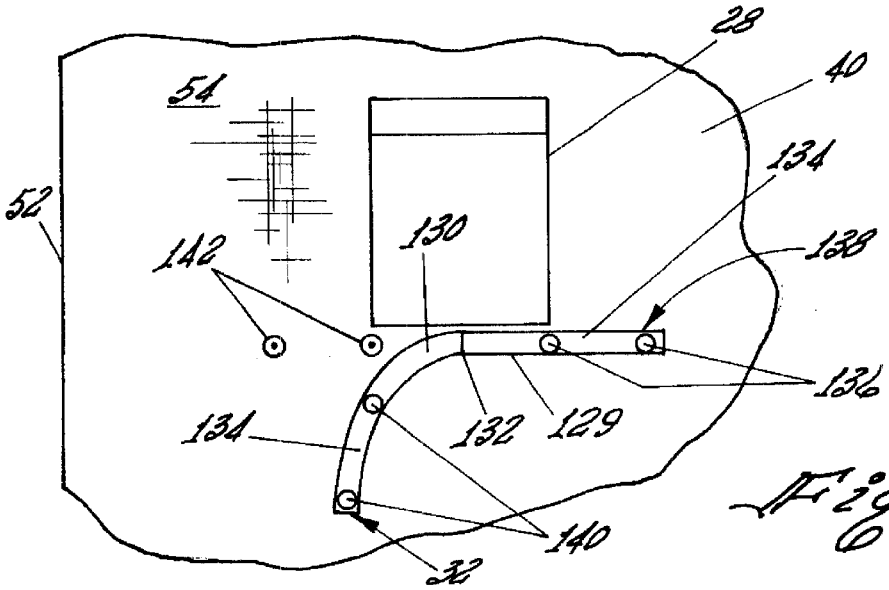
FIG. 5 is an enlarged, fragmentary elevation of a portion of the front panel of the gown, showing the front outside pocket and the front outside hanger, with two of the snaps on the same side of the hanger unsnapped so that the hanger is partially opened.
Figure 6:
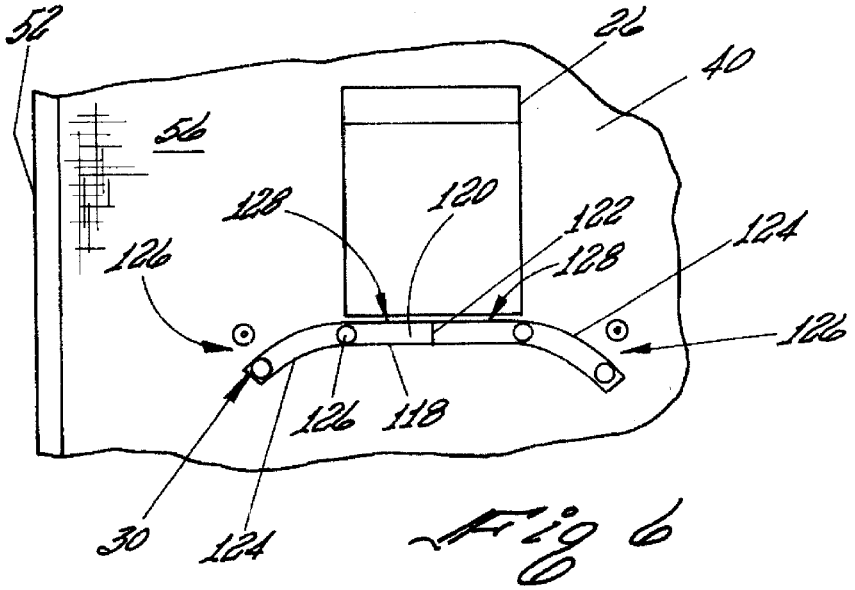
FIG. 6 is a view similar to FIG. 5, showing the front outside pocket and the front outside hanger, with two of the snaps at opposite ends of the hanger shown unsnapped so that the hanger is partially opened.
Figure 7:
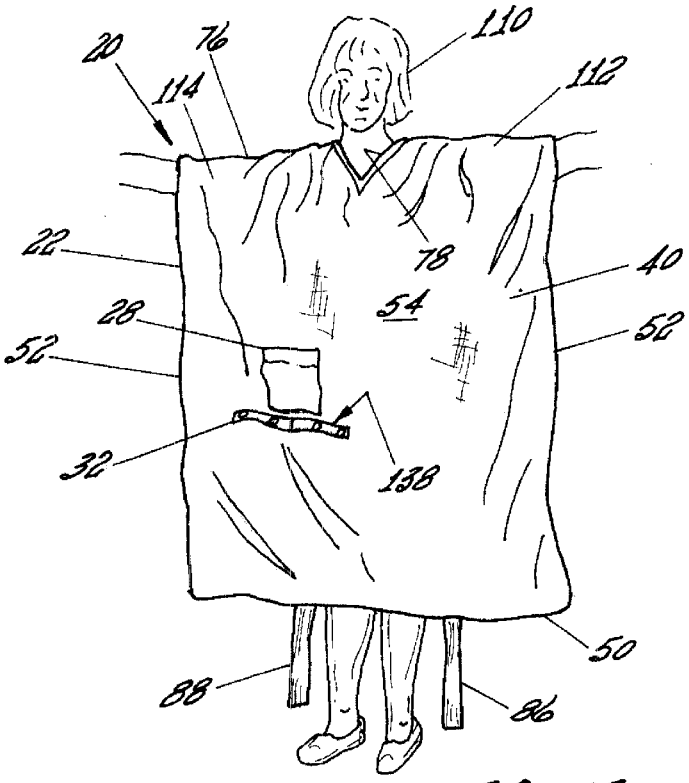
FIG. 7 is an isometric front elevation of the subject gown on a patient with the patient's arms extended to show the fullness of the gown draped down from the arms and the belting untied and hanging down in the back and without any medical appliances supported on the gown or attached to the patient.
Figure 10:
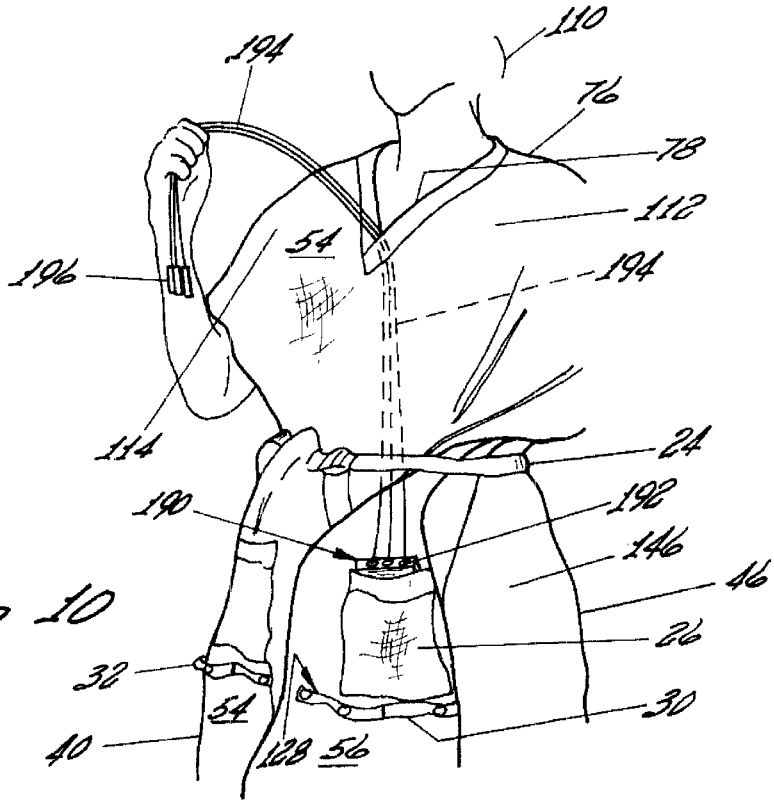
FIG. 10 is a fragmentary view (on about the same scale as FIG. 8) of the subject gown on a patient and belted, with a transmitter of a telemetry unit supported in the inside front pocket, and with the leads extending upwardly from the transmitter and out of the garment through the head and neck opening and being held by the patient to show how the leads and sensors are accessible through such opening although parts of the telemetry unit are inside the gown, it being noted that the front panel of the gown is shown pulled open and forwardly at the right so as to show the transmitter in the inside pocket.

With continued reference to FIGS. 2, 6, and 10, the inside hanger 30 includes an elongated strip 118 of cloth, preferably of the same fabric as the garment, sewn to the inside surface 56 of the front panel 40 immediately under the inside pocket 26. This strip has a central portion 120 fastened to the front panel by stitching 122 and outer end portions 124 releasably connected to the front panel by spaced snap-fasteners 126, preferably metallic, thereby forming annular closed loops 128 between the strip and the front panel when the corresponding fasteners are snapped together. Each end portion is preferably fastened to the front panel by a pair of spaced fasteners so that a pair of loops is defined between the adjacent pairs of fasteners, the front panel and the hanger strip. Thus, the inside hanger defines four detachable loops in the preferred embodiment. It is also to be noted that the stitching 122 is centered immediately below the inside pocket, and the outer end portions 124 terminate outwardly of the pocket on each side thereof.

The outside hanger 32 (FIGS. 1, 5 and 8) is constructed identically to the inside hanger 30 but is fastened to the outside surface 54 of the front panel 40 immediately below the outside pocket 28. Thus, the outside hanger has a strip 129 providing a central portion 130 fastened to the front panel by stitches 132, outer end portions 134 releasably fastened to the front panel by snap-fasteners 136 thereby defining four loops 138. These snap-fasteners 126 and 136 are well known and include a male member, as 140 in FIG. 5, on the strip and a female member, as 142 in FIG. 5, on the panel.

Description of Use and Method

When the garment 22 is placed on a patient 110 (FIGS. 7–11), the front and back panels 40 and 42 drape downwardly from the shoulders of the patient and, as noted above, provide sleeve portions 112 and 114 that are open under the arms along the side edges 52 and 68. Also, the garment provides side openings 140 between the side edges that provide full access out by the patient or in by an attendant. In putting the garment on, and assuming that the garment is to be tied in front, the front panel is tucked inside of the back panel so that both panels are partially wrapped around the patient but the back panel overlaps the front panel. Thereafter, the belt members 86 and 88 are pulled around from the rear and tied in the front, as shown in FIGS. 8–11. Alternatively, but not shown, the belt members may be tied in back to leave the side edges completely free for greater ease of access.

Figure 8:
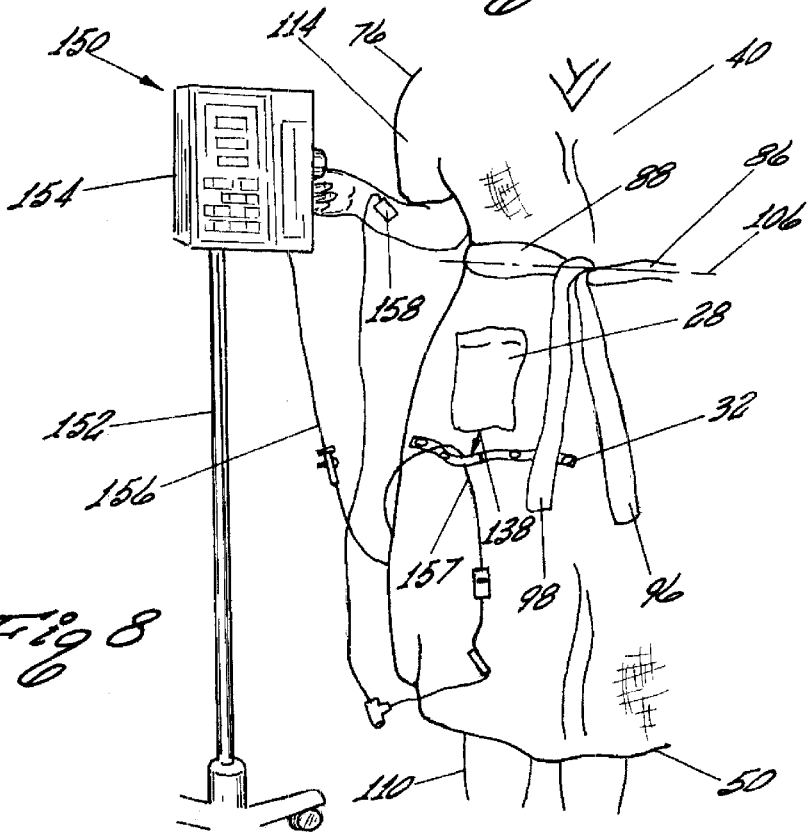
FIG. 8 is an enlarged, fragmentary, isometric front elevation of the patient wearing the gown in belted condition, i.e., with the belting tied, with the line of tubing of an intravenous unit connected to the patient's arm, with the tubing of the intravenous unit threaded through, draped and supported on one of the hangers of the gown, and with the patient grasping the mobile stand on which the pump of the intravenous unit is supported.
Figure 11:
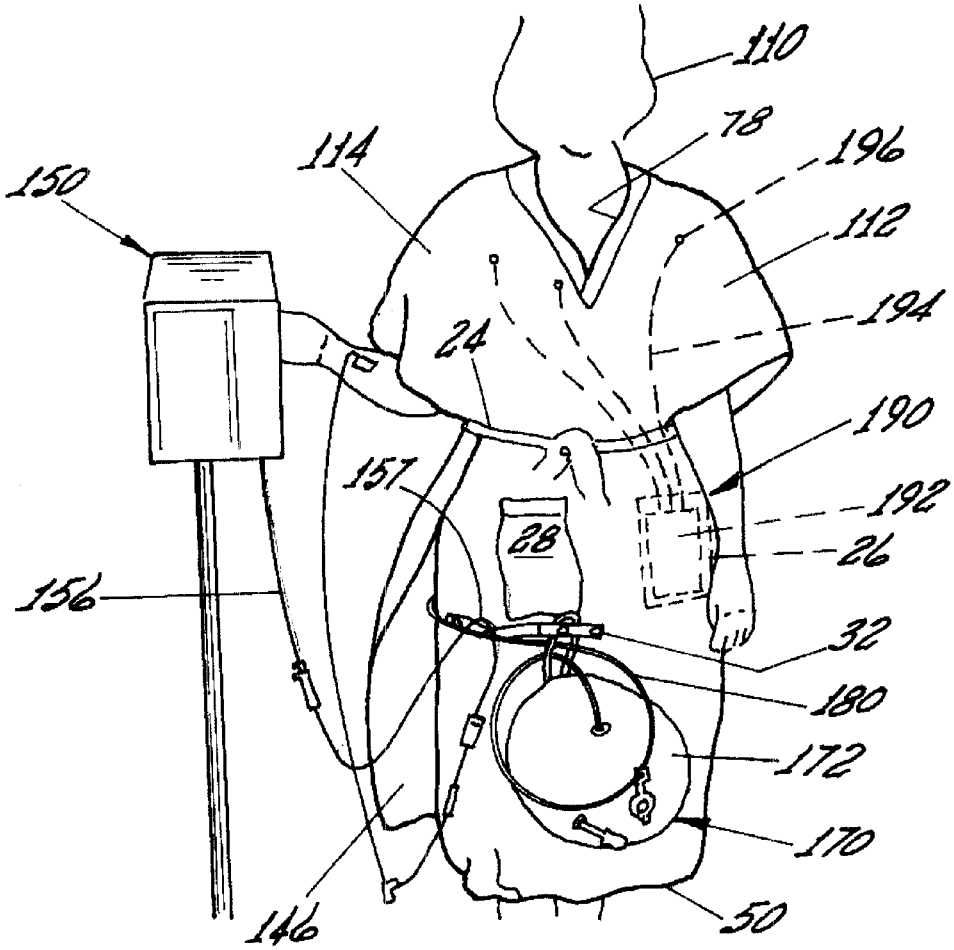
FIG. 11 is an isometric, front elevation, on about the same scale as FIG. 7, of the patient wearing the gown, belted, and supporting three medical appliances, namely, the telemetry unit shown in dashed lines and attached to the patient's chest area, the catheter unit supported as in FIG. 9 and attached to the patient through one of the side openings, the IV unit with its line of tubing supported as in FIG. 8 and attached to the patient's arm, and with the patient grasping the mobile stand of the IV unit in the way the patient would when the patient is up and ambulatory wearing the subject gown.

The gown 20 (FIGS. 7–11) is of particular value because it allows various medical appliances to be supported in various ways so as to assist the patient 110 to which these particular appliances are attached. Thus, an intravenous or IV unit 150 is generally indicated in FIGS. 8 and 11 and includes a mobile stand 152, a pump/container 154 holding a supply of fluid, and a line of tubing 156 leading from the container to an outer end 158 that is attached to the patient's arm in a well known manner. Using the outside hanger 32 of the subject gown, the tubing 156 is placed within and hung on one of the loops 138 of the hanger. Since the IV tubing is usually attached to the patient's arm before the garment 22 is put on, or at least is attached independently of wearing the garment, the subject invention facilitates subsequent support of the tubing on the gown. That is, one of outer end portions 134 of the outer hanger is released by unfastening an endwardly disposed snap-fastener 136. The tubing is then placed between the strip 129 and the front panel 40, and then the snap-fastener 136 is re-fastened so that the tubing is retained in the loop 138 that is formed. Thus, the hanger supports the tubing and prevents it from dragging on the floor or becoming tangled with the patient's feet and possibly causing the patient to trip and fall.

Figure 9:
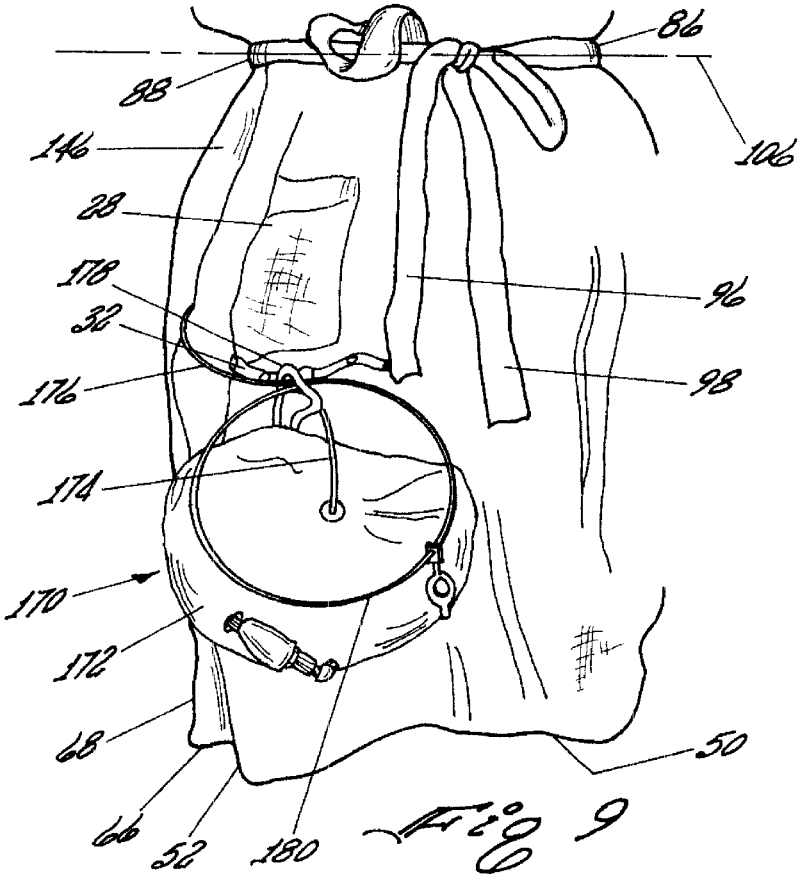
FIG. 9 is a somewhat enlarged (relative to FIG. 8), fragmentary view of the subject gown on a patient and belted and with a catheter unit hung on the front outside hanger of the gown, it being noted that the tubing of the catheter unit is coiled and supported in the hanger from where it extends around the left side of the front panel of the gown and thence underneath the gown to the patient's body.

Next, with reference to FIG. 9, a catheter unit 170 is shown including a bag or receptacle 172 and a tubing 174 connected to the bag and having an outer end 176 extending through one of the side openings 146 and connected to the patient 110 under the garment 22. The catheter unit also includes a hook 178 that enables the bag to be hung on one of the hangers 30 or 32. Assuming that it is hung on the front hanger 32 on the outside of the garment, as shown in FIG. 9, the tubing 174 is wound in a coil 180, and the coil is placed within one of the loops 138 after unsnapping the appropriate fastener 136, inserting the coil, and then re-snapping the fastener, in a manner similar to that described above with regard to the IV unit 150. Once again, the catheter unit is supported on the gown, and the coil of tubing in particular is kept off the floor and does not interfere with the patient's walking.

A patient 110 (FIG. 9) may prefer to support the catheter unit 170 on the inside hanger 30 whereupon the entire catheter unit will be concealed by the garment 22. Still, depending on patient preferences at various times and on the needs of attendants such as physical therapists, it is desirable to be able to have the flexibility of being able to hang the catheter unit either inside or outside of the garment. Such a change is easy to accomplish with the subject gown as will be understood. Thus, having both inside and outside hangers is very advantageous. In either case, it is important that the hangers 30 and 32 are located in their lower positions underneath the pockets 26 and 28 so that when the catheter is supported on a hanger, the bag is low enough, below the bladder of the patient, to prevent back flow of urine to the patient's bladder which, if allowed to occur, can cause urinary track infections. Accordingly. the subject gown affords the patient both personal privacy and medical safety.

Still further, referring to FIGS. 10 and 11, a telemetry unit 190 is shown. This unit includes a transmitter 192, leads 194 that are extended from the transmitter up to the patient's chest, and sensors 196 that are connected to the patient 110 in the usual manner (FIG. 11). The upper ends of the leads are shown held in the patient's hand outside of the garment 22 in FIG. 10 to illustrate how access through the opening 78 enables an attendant to work with the leads and sensors if needed, e.g., to re-position them on the patient's body. The subject gown is once again useful in supporting the telemetry unit in two ways. First, the transmitter is placed in one of the pockets, preferably the inside pocket since its location there provides the most direct route to the patient's chest where the sensors are attached. Secondly, when the telemetry unit is attached to the patient, the transmitter is in the inside pocket, the garment is wrapped around the patient, and the belting 24 is tied in front, the left belt member 86 applies some pressure to the leads 194 so that some of the weight of the transmitter is relieved from the sensors' pull on the patient's chest. In other words, since the transmitter is weighty and somewhat cumbersome, locating the pocket below the belt line 106 enables the belting to hold the transmitter in place and reduce some of the pulling stress of the transmitter on the sensors that are attached to the patient.

Although FIGS. 7–10 show how the gown functions with individual medical appliances, such as 150, 170 and 190, supported one at a time, the subject gown is especially advantageous since it is intended to support multiple medical appliances simultaneously. With reference to FIG. 11, therefore, the subject gown 20 is shown with all three of the medical appliances 150, 170, and 190 both attached to the patient and supported on the garment 22, all as individually described above. With the assistance given to the patient by the subject gown, the patient is encouraged to be up and ambulatory even though connected to all of these various appliances at the same time. As illustrated in FIG. 11, the patient is free to move about and to use his or her hand or hands to grasp the IV mobile stand 152 in order to move it along with the patient as he or she walks around or to grab onto some other structure for balance if necessary. With the subject gown, there is no need for the patient to be holding the tubes 156 or 174 or the leads 194 since these are appropriately supported by the garment. In this manner, the patient is free to use his or her hands in various ways including those noted and otherwise.

From the foregoing it will be understood that multipurpose medical clothing, illustrated and described in the embodiment of a gown, has been provided that accommodates several medical appliances at the same time while affording the patient privacy and dignity and giving the patient encouragement to be up and ambulatory. The clothing and the appliances thus together comprise a medical apparatus that not only facilitates use of various medical appliances but also encourages the patient to move around instead being confined to a bed. In this way, there is greater hope that the patient will make a more rapid recovery and will be able to be discharged from the hospital sooner. Although the invention has been shown and described in a gown that fits over the patient's head, the features of the subject invention including the belting, the pockets, the hangers, and their relative locations, may be incorporated in a robe that has sleeves and is worn by placing the patient's arms in the sleeves and folding the robe around to be belted in front, as is well known, or in other types of clothing.

Although a preferred embodiment of the present invention has been shown and described, various modifications, substitutions and equivalents may be used therein without departing from the spirit and scope of the invention. Accordingly, it is to be understood that the present invention has been described by way of illustration and not limitation.

What is claimed is:

1. A medical gown, comprising:

a garment including opposed substantially rectangular front and back panels each having upper and lower edges and opposite side edges, each panel having opposite inside and outside surfaces, the panels being joined at their upper edges but not at their side edges, the garment providing a head opening adjacent to said upper edges, the panels defining side openings allowing access to said inside surfaces from exteriorly of the garment, the length of the back panel from the upper edge to the lower edge being longer than the corresponding length of the front panel;

belting mounted on the back panel and having end portions long enough to enable them to be extended along a belt line across the side openings and transversely of the outside surface of the front panel so as to be tied in front of the front panel;

a pocket attached to one of the surfaces of the front panel below said belt line; and a hanger attached to one of the surfaces of the front panel below said belt line.

2. The clothing of claim 1, wherein there are inside and outside pockets and hangers.

3. The clothing of claim 2, wherein the inside and outside pockets and hangers are on the opposite sides of a longitudinal centerline extending from the upper edge to the lower edge midway between the side edges.

4. The clothing of claim 1, wherein the hanger is located below the pocket and constitutes means for supporting the bag of a catheter unit below the bladder of a patient wearing the gown.

5. A medical gown, comprising:

a garment including opposed front and back panels each having a top and a bottom and opposite sides, each panel having opposite inside and outside surfaces, the panels being joined at their tops but not at their sides, the garment providing a head opening adjacent to said tops, adjacent sides of the panels defining side openings allowing access to said inside surfaces from exteriorly of the garment;

belting mounted on the back panel and having end portions long enough to enable them to be extended along a belt line across the side openings and transversely of the outside surface of the front panel so as to be tied in front of the front panel;

a front outside pocket attached to the outside surface of the front panel below said belt line;

a front inside pocket attached to the inside surface of the front panel below said belt line and positioned on the panel in transversely spaced relation to the outside pocket although on the opposite side of the front panel from the outside pocket;

a front outside hanger attached to the outside surface of the front panel below the front outside pocket and having a hanger portion spaced from the outside surface of the front panel; and a front inside hanger attached to the inside surface of the front panel below the front outside pocket and having a hanger portion spaced from the inside surface of the front panel.

6. The gown of claim 5, wherein the hangers are releasably attached to the front panel.

7. The gown of claim 5, wherein each hanger has a central portion and opposite end portions extending from the central portion, wherein the central portion of each hanger is fastened to front panel intermediate the end portions of its respective hanger; and wherein there are releasable fasteners on the end portions of the hangers and the front panel.

8. The gown of claim 7, wherein each fastener is a releasable snap having a male member on one of the hanger and the panel and a female member on the other of the hanger and the panel.

9. The gown of claim 7, wherein there is more than one fastener member on each end portion of the hangers and corresponding fastener members on the front panel.

10. The gown of claim 5, wherein the tops of the front and back panels have upper edges that are fastened together;

wherein the bottoms of the panels have lower edges;

wherein the sides of the panels have opposite side edges;

wherein the widths of the panels from one side edge to the other are substantially equal;

wherein the width of each panel is sufficient to wrap at least more than half way around the patient wearing the clothing; and wherein the length of the back panel from its upper edge to its lower edge is longer than the length of the front panel from its upper edge to its lower edge.

11. A medical gown, comprising:

a garment including opposed front and back panels, each panel having upper and lower edges, opposite side edges, and opposite inside and outside surfaces, the panels being joined at their upper edges but not at their side edges, the garment providing a head opening adjacent to said upper edges, the panels defining side openings allowing access to said inside surfaces from exteriorly of the garment;

belting mounted on one of the panels and having end portions long enough to enable them to be extended along a belt line across the side openings and transversely of the panels so as to be tied adjacent to one of the panels;

a pocket attached to one of the surfaces of one of the panels below said belt line; and a hanger attached to one of the surfaces of one of the panels below said belt line.

12. The gown of claim 11, wherein the hanger is below the pocket.

13. The gown of claim 11, wherein there is a pocket and a hanger attached to each of said inside and outside surfaces of one of the panels.

14. The gown of claim 11, wherein a hanger is positioned immediately below each pocket, and wherein each pocket and its adjacent hanger are spaced from a longitudinal centerline extending from the upper edge to the lower edge midway between the side edges.

15. The gown of claim 11, wherein each hanger has a central portion and opposite end portions extending from the central portion, wherein the central portion of each hanger is fastened to the front panel intermediate the end portions of its respective hanger; and wherein there are releasable fasteners on the end portions of the hangers and the front panel.

16. The gown of claim 15, wherein each fastener is a releasable snap having a male member on one of the hanger and the panel and a female member on the other of the hanger and the panel.

17. The gown of claim 15, wherein there is more than one fastener member on each end portion of the hangers and corresponding fastener members on the front panel.

18. A medical gown, comprising:

a garment including opposed front and back panels of substantially the same width, each panel having upper and lower edges, opposite side edges, and opposite inside and outside surfaces, the panels being joined at their upper edges but not at their side edges, the garment providing a head opening adjacent to said upper edges, the panels defining side openings allowing access to said inside surfaces from exteriorly of the garment, adjacent side edges of the front and back panels being releasably overlapped at each side of the garment, belting mounted on one of the panels and having end portions long enough to enable them to be extended along a belt line across the side openings and transversely of the panels so as to be tied adjacent to one of the panels, the belting defining a belt line that circumscribes the garment between the upper and lower edges;

a pocket attached to one of the surfaces of one of the panels below said belt line; and a hanger attached to one of the surfaces of one of the panels below said belt line.

19. The garment of claim 18, wherein the back panel is longer than the front panel, wherein the lower edge of the back panel is at about the same distance from the belt line as the lower edge of the front panel with the belting tied.

* * * * *